US010059885B2

(12) United States Patent
Schmit et al.

(10) Patent No.: US 10,059,885 B2
(45) Date of Patent: Aug. 28, 2018

(54) METHOD FOR PRODUCING PULVERIZED COAL

(75) Inventors: Louis Schmit, Luxembourg (LU); Georges Stamatakis, Canach (LU); Guy Junk, Ettlebruck (LU); Claude Junk, legal representative, Vianden (LU); Benoît Junk, legal representative, Ettelbruck (LU)

(73) Assignee: PAUL WURTH S.A., Luxembourg (LU)

( * ) Notice: Subject to any disclaimer, the term of this patent is extended or adjusted under 35 U.S.C. 154(b) by 976 days.

(21) Appl. No.: 12/995,007

(22) PCT Filed: Jun. 2, 2009

(86) PCT No.: PCT/EP2009/056761

§ 371 (c)(1),
(2), (4) Date: Apr. 26, 2011

(87) PCT Pub. No.: WO2009/147151

PCT Pub. Date: Dec. 10, 2009

(65) Prior Publication Data

US 2011/0192080 A1 Aug. 11, 2011

(30) Foreign Application Priority Data

Jun. 2, 2008 (LU) ..... 91450

(51) Int. Cl.
*C10L 8/00* (2006.01)
*C10B 57/10* (2006.01)
(Continued)

(52) U.S. Cl.
CPC ..... *C10B 57/10* (2013.01); *C21B 5/003* (2013.01); *F26B 17/103* (2013.01); *F26B 21/06* (2013.01)

(58) Field of Classification Search
CPC ..... C10B 57/10; C21B 5/003; F26B 17/103; F26B 21/06
(Continued)

(56) References Cited

U.S. PATENT DOCUMENTS 4,244,529 A 1/1981 DeGabriele et al.
4,280,283 A * 7/1981 Ansen et al. ..... 34/371
4,498,632 A * 2/1985 Ruter ..... 241/18

FOREIGN PATENT DOCUMENTS

DE 2656046 A1 6/1978
EP 0030376 6/1981
(Continued)

OTHER PUBLICATIONS

International Search Report PCT/EP2009/056761; dated Aug. 31, 2009.
(Continued)

*Primary Examiner* — Latosha Hines
(74) *Attorney, Agent, or Firm* — Cantor Colburn LLP

(57) ABSTRACT

Method for producing pulverized coal, the method comprising the steps of heating a drying gas, preferably an inert gas, in a hot gas generator (26) to a predefined temperature; feeding the heated drying gas into a pulverizer (20); introducing raw coal into the pulverizer (20), the pulverizer (20) grinding the raw coal to pulverized coal; collecting a mixture of drying gas and pulverized coal from the pulverizer (20) and feeding the mixture to a filter (34), the filter (34) separating the dried pulverized coal from the drying gas; and collecting the dried pulverized coal for further use and feeding part of the drying gas from the filter to a recirculation line (38) for returning at least part of the drying gas to the hot gas generator (26). According to an important aspect of the present invention, the method comprises the further step of controlling an exit temperature of the mixture of drying gas and pulverized coal exiting the pulverizer (20) by
(Continued)

controlling a volume of water injected into the heated drying gas before feeding it into the pulverizer (20).

12 Claims, 1 Drawing Sheet

(51) Int. Cl.
*C21B 5/00* (2006.01)
*F26B 17/10* (2006.01)
*F26B 21/06* (2006.01)

(58) Field of Classification Search
USPC ..... 44/621; 241/18
See application file for complete search history.

(56) References Cited

FOREIGN PATENT DOCUMENTS

| | | | | |
|---|---|---|---|---|
| EP | 0467375 | A1 | | 1/1992 |
| GB | 1467744 | A | * | 3/1977 |
| GB | 1467744 | | | 3/2007 |
| JP | 51-46302 | | | 4/1976 |
| JP | 61-153213 | A | | 7/1986 |
| JP | 04-080307 | A | | 3/1992 |
| KR | 20020055718 | | | 7/2002 |

OTHER PUBLICATIONS

ISR PCT/EP2009/056763 dated Sep. 15, 2009.
Japanese Patent Application No. P2011-511035 Office Action; dated Sep. 4, 2013.
Japanese Office Action (Translation), Patent Application No. P2011-511036, Takayasu Anzi, Dec. 25, 2013. 8 pages.

* cited by examiner

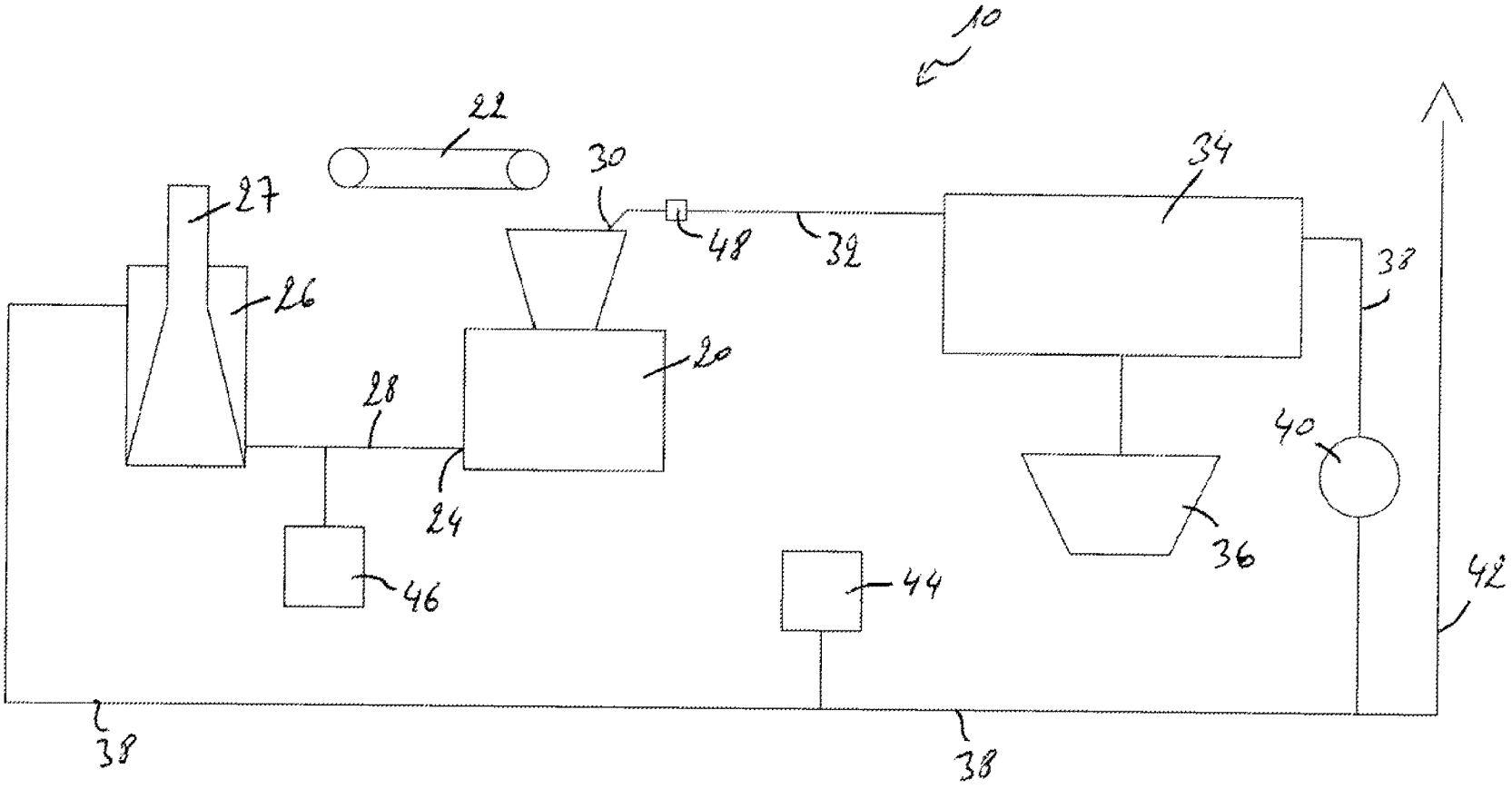
10
22
27
26
28
46
24
20
30
48
32
34
44
36
38
40
38
42

METHOD FOR PRODUCING PULVERIZED COAL

TECHNICAL FIELD

The present invention generally relates to a method for the production of pulverized coal, in particular for use in the metallurgical industry.

BACKGROUND

In the metallurgical industry, pulverized coal is generally injected as combustible into blast furnaces. It is important, in order to ensure good functioning of the blast furnace, that the pulverized coal is of good quality, i.e. that the pulverized coal has the right consistence, size and humidity level. The pulverized coal is generally produced in a grinding and drying installation, wherein raw coal is ground in a pulverizer and dried to the right humidity level before the resulting pulverized coal is fed to a hopper for storage or direct use in a blast furnace. It is known to subject the freshly ground coal to a stream of hot gas so as to dry the pulverized coal. The pulverized coal can e.g. be entrained by the hot gas from the pulverizer to a filter, where the pulverized coal is then separated from the gas and fed to the hopper. Part of the gas is recirculated and heated before it is reintroduced into the pulverizer.

For the correct functioning of the grinding and drying installation, it is important to monitor the temperature of the gas at the exit of the pulverizer. If the temperature is too high, there is a risk that the filter, downstream of the pulverizer, is damaged by the hot gasses. If this occurs, the filter can no longer function properly and must be repaired or replaced, entraining unscheduled process stoppage and undesired maintenance costs.

Known grinding and drying installations are provided with an emergency cooling system associated with the pulverizer, wherein, if the temperature at the exit of the pulverizer exceeds a predetermined threshold, the emergency cooling system injects water into the pulverizer chamber, thereby cooling the gas. Such an emergency cooling system is generally also linked to emergency shut-off valves, e.g. one arranged at the gas inlet into the pulverizer and one at the gas outlet of the filter, so as to cut circulation of the gas through the installation, thereby effectively shutting down the grinding and drying installation.

A major problem with this solution is that due to the shutting down of the grinding and drying installation, the whole pulverized coal producing process is stopped for a certain period of time, resulting in loss of production. When the process is then started again, further problems occur. Indeed, during a startup phase of such a grinding and drying installation, gas is fed through the system before raw coal is introduced into the pulverizer. This allows the individual components to be heated to the desired working temperature. When the raw coal introduction is then started, a sudden drop in temperature at the exit of the pulverizer occurs due to the addition of cold and wet material. The gas is then further heated upstream of the pulverizer to compensate for this temperature drop. However, in such a grinding and drying installation, there is a relatively long transition time, i.e. the time it takes the exit temperature to reach the desired working temperature after the sudden temperature drop. During this transition time, wherein the temperature is too low, the pulverized coal is not dried sufficiently, such that the pulverized coal produced by the grinding and drying installation during the transition time has a humidity level too high to be used in blast furnace. Indeed, during the transition time the grinding and drying installation produces unusable coal slurry instead of valuable pulverized coal.

BRIEF SUMMARY

The invention provides an improved method for producing pulverized coal, which does not present the drawbacks of the prior art methods.

More specifically, the present invention proposes a method for producing pulverized coal, the method comprising the steps of:

- heating a drying gas, preferably an inert gas, in a hot gas generator to a predefined temperature;
- feeding the heated drying gas into a pulverizer;
- introducing raw coal into the pulverizer, the pulverizer grinding the raw coal to pulverized coal;
- collecting a mixture of drying gas and pulverized coal from the pulverizer and feeding the mixture to a filter, the filter separating the dried pulverized coal from the drying gas;
- collecting the dried pulverized coal for further use and feeding part of the drying gas from the filter to a recirculation line for returning at least part of the drying gas to the hot gas generator According to an important aspect of the present invention, the method comprises the further step of controlling an exit temperature of the mixture of drying gas and pulverized coal exiting the pulverizer by controlling a volume of water injected into the heated drying gas before feeding it into the pulverizer.

By controlling the amount of water injected into the drying gas upstream of the pulverizer, the temperature of the drying gas entering the pulverizer can be adjusted rapidly so as to take into account temperature differences occurring due to raw coal with different levels of humidity being introduces into the pulverizer. It is thereby possible to maintain the temperature of the drying gas exiting the pulverizer, hereafter referred to as exit temperature, as constant as possible.

The present method is of particular advantage during a startup phase of the installation, wherein the method comprises a startup cycle wherein heated drying gas is fed through the pulverizer without introducing raw coal, the exit temperature being kept below a first temperature threshold, and a grinding cycle wherein heated drying gas is fed through the pulverizer and raw coal is introduced into the pulverizer, the exit temperature being kept at a preferred working temperature. According to an important aspect of the invention, the method comprises:

- during the startup cycle, heating said drying gas to a temperature above the first temperature threshold and injecting a volume of water into the heated drying gas, the volume of water being calculated so as to reduce the temperature of the heated drying gas to obtain an exit temperature below the first temperature threshold; and
- at the beginning of the grinding cycle, reducing the volume of water injected into the heated drying gas so as to compensate for the drop in exit temperature.

During the startup cycle, the drying gas is heated to a temperature above a first temperature threshold and a volume of water is injected into the heated drying gas, the volume of water being calculated so as to reduce the temperature of the heated drying gas to obtain an exit temperature below the first temperature threshold. At the beginning of the grinding cycle, the volume of water injected into the heated drying gas is reduced so as to compensate for the drop in exit temperature and regulate the exit temperature to a preferred working temperature.

During a startup phase of the installation, drying gas is generally fed through the installation before raw coal is introduced into the pulverizer. This allows the individual components to be heated to the desired working temperature. By controlling the amount of water injected into the drying gas upstream of the pulverizer during this startup phase, the drying gas, which may be heated to a temperature above the maximum tolerated exit temperature, can be cooled down again so that the temperature downstream of the pulverizer does not exceed the first temperature threshold.

When the raw coal introduction is then started, a sudden drop in exit temperature occurs due to the addition of cold and wet material. By overheating the drying gas in the hot gas generator and subsequently cooling it through water injection, the temperature of the drying gas entering the pulverizer can be quickly adapted to the new operating conditions. A reduction of the quantity of injected water allows a rapid temperature increase of the drying gas entering the pulverizer so as to compensate for the temperature drop due to the introduction of the raw coal. As a consequence, the transition time, wherein pulverized coal is produced at lower temperature is considerably reduced. The amount of unusable coal slurry is also considerably reduced, thereby increasing the efficiency of the installation.

The volume of water injected into the heated drying gas can be determined based on the exit temperature. Alternatively, the volume of water injected into the heated drying gas can be determined based on a pressure drop measured across the pulverizer. It is not excluded to use other measurements, alone or in combination, to determine the volume of water to be injected into the heated drying gas.

Preferably, during the grinding cycle and after compensation for the drop in exit temperature, the method comprises the further steps of reducing the heating of the drying gas; and reducing the volume of water injected into the heated drying gas to maintain the desired exit temperature. This allows reducing consumption of energy once the installation is running. Indeed, the importance of the overheating and subsequent cooling of the drying gas is particularly important during the startup phase of the installation, wherein it allows providing a buffer to compensate for the drop in temperature occurring when the introduction of raw coal is started. Once the installation is running, only smaller temperature drops might occur and the buffer can be reduced. During normal operation of the grinding and drying installation, there is hence no need to over heat the drying gas in the hot gas generator and subsequently cooling it to the working temperature.

In the recirculation line, part of the drying gas can be extracted as exhaust gas. Air and/or hot gas is preferably injected into the drying gas in the recirculation line.

According to a preferred embodiment of the invention, the oxygen level in the drying gas is monitored and, if the oxygen level is higher that a predetermined oxygen threshold, the volume of air injected into the drying gas is reduced and/or the volume of water injected into the drying gas is increased. Controlling the oxygen levels allows maintaining correct inert conditions of the drying gas.

According to a preferred embodiment of the invention, if the oxygen level is higher than a predetermined oxygen threshold, first, the volume of air injected into the drying gas is reduced; and if the volume of air injected reaches zero and the oxygen level is still higher than a predetermined oxygen threshold, the volume of water injected into the drying gas is increased.

The method may also comprise continuous monitoring of the exit temperature and comparing the measured exit temperature to a maximum temperature, wherein, if the measured exit temperature exceeds the maximum temperature, the volume of water injected into the heated drying gas is increased. This allows using the water injection means used for general process control, to be used for emergency cooling also.

BRIEF DESCRIPTION OF THE DRAWINGS

The present invention will be more apparent from the following description of one not limiting embodiment with reference to the attached drawing, wherein FIG. 1 shows a schematic representation of a grinding and drying installation used for carrying out the method according to the present invention.

DETAILED DESCRIPTION

FIG. 1 shows a grinding and drying installation for producing pulverized coal using the method according to the present invention.

Such a grinding and drying installation 10 comprises a pulverizer 20 into which raw coal is fed via a conveyor 22. In the pulverizer 20, the raw coal is crushed between internal mobile pieces (not shown) or any other conventional grinding means into a fine powder. At the same time, a hot drying gas is fed through the pulverizer 20 to dry the pulverized coal. The drying gas enters the pulverizer 20 through a gas inlet 24. Upstream of the pulverizer 20, the grinding and drying installation 10 comprises a hot gas generator 26 in which a drying gas can be heated to a predefined temperature. Such a hot gas generator 26 is powered by a burner 27, such as e.g. a multiple lance burner. The heated drying gas is carried from the hot gas generator 26 to the pulverizer 20 via a conduit 28. As the heated drying gas passes through the pulverizer 20, from the gas inlet 24 to an outlet 30, pulverized coal is entrained. A mixture of pulverized coal and drying gas is carried from the pulverizer 20, via a conduit 32, to a filter 34, where the pulverized coal is again removed from the drying gas and fed to a pulverized coal collector 36, ready further use. The drying gas exiting the filter 34 is fed to a recirculation line 38 for feeding it back to the hot gas generator 26. The recirculation line 38 comprises fan means 40 for circulating the drying gas through the installation. The fan means 40 may be located upstream or downstream of a line 42, e.g. a stack, which is used to extract part of the drying gas from the recirculation line 38.

The recirculation line 38 further comprises gas injection means 44 for injecting fresh air and/or hot gas into the recirculation line 38. The injected fresh air and/or hot gas is mixed with the recycled drying gas. The injected fresh air allows reducing the due point of the drying gas and the injected hot gas is used to improve the thermal balance of the grinding and drying circuit.

According to an important aspect of the present invention, the installation 10 comprises water injection means 46 arranged downstream of the hot gas generator 26 and upstream of the pulverizer 20. The importance of the water injection means 46 will become clear in the description herebelow.

In operation, the drying gas is heated to a predefined temperature in the hot gas generator 26 and fed through the pulverizer 20. The temperature of the drying gas is reduced in the pulverizer 20 as the heat from the drying gas is used to dry the pulverized coal. The level of humidity of the raw coal determines the temperature loss of the drying gas. In order to prevent damage to the filter 34, the temperature of the mixture of pulverized coal and drying gas exiting the pulverizer 20, hereafter referred to as the exit temperature, is monitored, e.g. by means of a temperature sensor 48.

In order to maintain a correct exit temperature, the temperature of the drying gas entering the pulverizer needs to be controlled, which is generally achieved by controlling the output power of the burner 27 of the hot gas generator 26. Unfortunately this process has a relatively slow response time, meaning that once the installation has determined that the exit temperature is too high or too low and the burner 27 has been made to react in consequence, some time passes before the exit temperature reaches the correct exit temperature again.

The response time is particularly important during a startup phase of the installation. Indeed, initially, heated drying gas is fed through the installation before the raw coal is introduced. This allows the installation to heat up and reach the ideal working conditions. When, after a certain time, raw coal is then introduced into the pulverizer 20, the exit temperature suddenly drops well below the desired exit temperature. Conventionally, the burner 27 then reacts by further heating the drying gas so as to reach the desired exit temperature. The desired exit temperature is then however only obtained after a long delay and any pulverized coal obtained in the meantime may have to be discarded because it has not been sufficiently dried. Indeed, during a transition period wherein the exit temperature is too low, unusable coal slurry is generally obtained instead of dried pulverized coal.

According to the present invention, during the startup phase, the burner 27 is set to heat the drying gas well above the desired exit temperature. The heated drying gas is then subjected to controlled cooling by injecting water into the heated drying gas through the water injection means 46, whereby the drying gas is cooled so that the desired exit temperature can be achieved. After a certain heat-up time of the grinding and drying installation, when the raw coal is introduced into the pulverizer 20, the exit temperature suddenly drops well below the desired exit temperature. Instead of compensating for this sudden drop by adapting the heating temperature of the burner 27, the amount of water injected into the drying gas by the water injection means 46 is reduced. The heated drying gas is hence cooled less and the desired exit temperature can be kept stable. The reaction time of this procedure is considerably lower than the conventional one, thereby considerably reducing or avoiding a transition period wherein the exit temperature is too low and the production of unusable coal slurry.

It should be noted that this method shows its most dramatic advantages during the startup phase, i.e. during a transition period shortly after raw coal is initially introduced into the pulverizer. The present method is however also advantageous during normal operation of the installation. When a reduction of the humidity in the raw coal occurs, the exit temperature can be quickly brought back to the desired exit temperature should a sudden drop in temperature occur.

In order to optimize energy consumption, it is advantageous to gradually reduce both the heating and the subsequent cooling of the drying gas once the exit temperature has stabilized. If no such subsequent cooling is required, the water injection system can be switched off.

Another function of the water injection means 46 may be to help regulate the dew point of the drying gas by regulating the oxygen level therein. In the recirculation line 38, part of the drying gas is extracted via the line 42 and fresh air may be injected via the gas injection means 44. In conventional installations, the oxygen level is monitored for safety reasons and, if the oxygen level is found to be too high, the gas injection means 44 is instructed to reduce the amount of fresh air introduced into the dying gas. A problem however occurs when the gas injection means 44 reaches its shut-off point, i.e. when the gas injection means 44 is completely turned off and no fresh air is injected into the dying gas. If the oxygen level is then still found to be too high, the volume of fresh air injected into the dying gas cannot be further reduced and a shutdown of the installation becomes necessary.

According to the present invention, the oxygen level in the drying gas can be reduced by injecting water into the drying gas by means of the water injection means 46. When the oxygen level is too high, the water injection means 46 can be instructed to increase the volume of water injected into the drying gas, thereby reducing the oxygen level downstream of the filter 34.

Preferably, the oxygen level is first reduced by the conventional method of reducing the volume of fresh air injected into the dying gas by the gas injection means 44 and if this is not sufficient, the oxygen level is then further reduced by increasing the volume of water injected into the drying gas by the water injection means 46.

Advantageously, the water injection means 46 is also used for an emergency cooling. The method may comprise continuous monitoring of the exit temperature and comparing the measured exit temperature to a maximum temperature. When the measured exit temperature exceeds the maximum temperature, the water injection means 46 is instructed to increasing the volume of water injected into the heated drying gas, thereby reducing the temperature of the drying gas entering the pulverizer 20 and consequently also the temperature of the drying gas exiting the pulverizer 20.

The invention claimed is:

1. Method for producing pulverized coal, the method comprising the steps of:

heating a drying gas in a hot gas generator to a first temperature;

feeding the heated drying gas into a pulverizer;

introducing raw coal into the pulverizer, the pulverizer turning the raw coal into pulverized coal;

collecting a mixture of drying gas and pulverized coal from the pulverizer and feeding the mixture to a filter, the filter separating the dried pulverized coal from the drying gas;

collecting the dried pulverized coal for further use and feeding part of the drying gas from the filter to a recirculation line for returning at least part of the drying gas to the hot gas generator wherein the method comprises a startup cycle wherein heated drying gas is fed through the pulverizer without introducing raw coal and water, a grinding cycle wherein heated drying gas is fed through the pulverizer and raw coal is introduced into the pulverizer, supplying water to the hot gas generator prior to when raw coal is fed to the pulverizer; and measuring an exit temperature downstream from the pulverizer and prior to the filter, wherein the exit temperature of the mixture of drying gas and pulverized coal is controlled by adjusting the volume of water injected into the heated drying gas before feeding it into the pulverizer, wherein during the startup cycle, adjusting a temperature of said drying gas to achieve a predetermined second temperature wherein the second temperature is above the first temperature, wherein the volume of water is injected into the heated drying gas between the hot gas generator and the pulverizer, and wherein the volume of water being increased during the startup cycle so as to reduce the temperature of the heated drying gas to compensate for the heating of the drying gas to the second temperature to obtain a substantially constant exit temperature; and at the beginning of the grinding cycle, reducing the volume of water injected into the heated drying gas so as to compensate for the drop in exit temperature and regulate the mixture of drying gas and pulverized coal at the substantially constant exit temperature.

2. Method according to claim 1, wherein the volume of water injected into the heated drying gas is determined based on the exit temperature.

3. Method according to claim 1, wherein the volume of water injected into the heated drying gas determined based on a pressure drop measured across the pulverizer.

4. Method according to claim 1, wherein, during the grinding cycle and after compensation for the drop in exit temperature, the method comprises the steps of:

reducing the heating of the drying gas to the first temperature; and reducing the volume of water injected into the heated drying gas to maintain the substantially constant exit temperature.

5. Method according to claim 1, wherein, in the recirculation line, at least part of the drying gas is extracted as exhaust gas.

6. Method according to claim 1, wherein, in the recirculation line, a volume of fresh air and/or a volume of hot gas is injected into the drying gas.

7. Method according to claim 6, wherein the oxygen level in the drying gas is monitored and, if the oxygen level is higher than an oxygen threshold, the volume of fresh air injected into the drying gas is reduced.

8. Method according to claim 1, wherein the oxygen level in the drying gas is monitored and, if the oxygen level is higher than an oxygen threshold, the volume of water injected into the drying gas is increased.

9. Method according to claim 8, wherein the oxygen level in the drying gas is monitored and, if the oxygen level is higher than an oxygen threshold, first, the volume of fresh air injected into the drying gas is reduced; and if the volume of fresh air injected reaches zero and the oxygen level is still higher than the oxygen threshold, the volume of water injected into the drying gas is increased.

10. Method according to claim 1, comprising:

continuous monitoring of the exit temperature and comparing the measured exit temperature to a maximum temperature; and if the measured exit temperature exceeds the maximum temperature, increasing the volume of water injected into the heated drying gas.

11. Method according to claim 1, wherein the drying gas is heated in a hot gas generator powered by a lance burner.

12. Method according to claim 1, wherein water is injected into the heated drying gas by means of a water injection device arranged between the hot gas generator and the pulverizer.

* * * * *